US005242484A

United States Patent [19]

Schönewolf et al.

[11] Patent Number: 5,242,484

[45] Date of Patent: Sep. 7, 1993

[54] PLANT FOR THE PROCESSING OF MOLTEN STEEL AND METHOD FOR THE OPERATION OF SUCH A PLANT

[75] Inventors: Georg Schönewolf, Duisburg; Jürgen Dörpinghaus, Moers; Horst Dieter Schöler, Duisburg, all of Fed. Rep. of Germany

[73] Assignee: Mannesmann Aktiengesselschaft, Dusseldorf, Fed. Rep. of Germany

[21] Appl. No.: 878,143

[22] Filed: May 4, 1992

[30] Foreign Application Priority Data

May 2, 1991 [DE] Fed. Rep. of Germany ..... 4114613

[51] Int. Cl.[5] ..... C21C 7/00

[52] U.S. Cl. ..... 75/508

[58] Field of Search ..... 75/560

[56] References Cited

U.S. PATENT DOCUMENTS 3,467,167 9/1969 Mahin ..... 75/560

*Primary Examiner*—Peter D. Rosenberg

*Attorney, Agent, or Firm*—Cohen, Pontani, Lieberman, Pavane

[57] ABSTRACT

A plant for secondary metallurgical processing of molten steel, having a melting apparatus and a continuous casting apparatus, a first station and a second station each having an associated evacuatable container for the molten steel, an oxygen feed device and an additive feed device. Each container receives a casting ladle, and has a vacuum-tight cover to provide a seal. A moderate vacuum device, e.g. a water ring pump and a high vacuum device, e.g. a water ring pump and a steam jet are provided, and are connected to the container via a device for selectively connecting the moderate vacuum device and the high vacuum device to the containers. The method for secondary metallurgical processing of steel melts, includes the steps of refining a melt with simultaneous addition of oxygen, boiling out of the melt subsequent to the addition of oxygen, addition of reducing agents to the melt and allowing sufficient processing time for the degassing and desulfurizing of the melt, sequentially subjecting a melt to a moderate intensity vacuum and a high intensity vacuum and correction of the melt analysis and alloying, at least one of the steps being carried out with simultaneous introduction of an inert gas into the melt.

18 Claims, 7 Drawing Sheets

Prior Art Course of Processing of VOD Melts

Prior Art Solution–Variant 1

Vacuum Plant Cycle Time:148 min.

Prior Art Solution – Variant 2
Vacuum Plant Cycle Time: 110 min.

Prior Art Solution–Variant 3
Vacuum Plant Cycle Time: 102 min.

PLANT FOR THE PROCESSING OF MOLTEN STEEL AND METHOD FOR THE OPERATION OF SUCH A PLANT

FIELD OF THE INVENTION

The present invention concerns a plant for the secondary metallurgical processing of molten steel which is arranged within a production sequence, consisting of a melting facility such as an electric furnace or converter and a casting facility, in particular a continuous casting plant.

BACKGROUND OF THE INVENTION

Such plant and aspects of the construction and theory of operation of the individual units of the plants, are known in principle, for example from "Stahl und Eisen" (Steel and Iron) 109, (1989), No. 22, pages 1047 to 1056, expressly incorporated herein by reference. The production of raw steel is in that case carried out in an electric-arc furnace or a converter. The molten steel is then fed to a station for the secondary metallurgical processing for completion of the processing, and is finally cast into ingots in a continuous casting plant.

Another such processing sequence is also known from Mannesmann Demag Hüttentechnik Prospectus 6.13.3.11 E 08.09.2000, expressly incorporated herein by reference, which discloses a VOD plant used as unit for the secondary metallurgical processing, as shown in FIG. 1 and the accompanying descriptive text.

In that case, the size of the individual components of the plant and their respective capacities are selected so that for a given output, a reliable flow of material within the processing sequence is assured. The course of the processing within the VOD station is explained with reference to FIG. 1, in which the process is broken down into phases A–F.

Phase A corresponds to the time for conducting or guiding the ladle to the place of processing. During this phase, the connection of inert gas is set up, the scavenging intensity is adjusted and the vessel is covered with a lid that is lined with a fire-proof material or water-cooled. The latter reduces the time in the present example by more than half.

Phase B corresponds to the time of the actual vacuum refining. An initial Carbon (C) content of 0.60% and a Silicon (Si) content of 0.20% is assumed for V2A quality steel. It is also to be understood that steels having varying alloy and impurity contents, i.e. differing in analysis, require shorter or longer processing times which must be taken into account.

Phase C corresponds to the boiling out time following the oxygen refining.

Phase D corresponds to the time for the feeding of the slag former and the reduction agent. In the event of use of a cover having fire-proof material, it is to be removed during this phase, in contradistinction to the case where a water-cooled cover is installed in the plant, which requires more time for removal.

Phase E corresponds to the reduction time, the duration of which depends on various requirements such as reduction, degassing and desulfurization.

Phase F corresponds to the time for correction of the analysis as well as the measurement of the temperature, together with the time for individual activities such as sampling, temperature measurement, alloying, the addition of cold scrap metal and covering of the ladle.

In the context of the production facilities arranged in front and behind of the processing apparatus, the known variants shown in FIGS. 2 to 4 are also possible.

The first variant, shown in FIG. 2, shows the original processing sequence with only one vacuum station. The second variant, shown in FIG. 3, provides for the final handling of the melt in a separate scavenging station.

The third variant, shown in FIG. 4, contains a second processing station. A further reduction of the cycle sequence duration is limited by the availability of the traditional single vacuum pump system, which ordinarily consists of a water ring pump and steam jet.

These known concepts of the processing sequence consisting of a melting facility, a VOD plant, and a casting facility do not represent fundamental solutions to the problem of lengthy net cycle times, and do not set forth a simple, generally applicable method for reducing the cycle time to attain or approach the desired short cycle times for melting and casting facilities. Additionally, these known solutions do not undertake to adapt one processing phase of the processing to another. Thus, changes in the known processing lines, after they have been established, were possible only by including an expensive additional metallurgical installation or by shifting of the finishing time of the melt toward the reduction processing in a separate scavenging stage. The overall prior art system is also inflexible with respect to changes in metallurgical or casting procedures which may have an effect on the cycle time of the individual stages in the sense of shortening these cycle times.

The problems presented by the prior art systems consist therefore of finding a solution which assures a high degree of flexibility and an adaptation of the VOD processing time to the cycle times of the melting and casting facilities arranged prior and subsequent to the processing stage.

The present invention proceeds from a known VOD plant. This consists generally of a combination of water ring pumps and the actual core of the vacuum plant, the steam jets.

SUMMARY AND OBJECTS OF THE INVENTION

It is an object of the present invention to provide a melt processing system having a greater control with respect to time of the melting and casting facilities arranged in front and behind of it by, for example, sequential casting in the case of continuous casting with greater melt efficiency or smaller size of the furnaces.

The advantages of the present invention obtained manifest themselves as increases in production with reduced investment and operating costs, an increased control of the vacuum facility and increased possibilities of adaptation of the VOD processing to the cycle sequence of the melting and casting units.

It is therefore an object of the present invention to provide a VOD plant which has a cycle time which can be adapted to the cycle times of the corresponding melting and casting plant elements which are arranged sequentially with it, to provide for process variations.

The present invention therefore provides a plant for the secondary metallurgical processing of molten steel within a production sequence consisting of a melting facility and a casting facility, in particular a continuous casting plant, having two stations, each having one evacuatable container containing a steel melt and having the devices for the feeding of oxygen and devices for the addition of additive materials to the melt and pipelines which connect the containers to a vacuum producing apparatus having one device consisting of a water ring pumping station for the producing of a moderate vacuum and one device consisting of water ring pumps and steam jets for the producing of a high vacuum, arranged in such manner that is may selectively connect the containers to only the device for the producing of a moderate vacuum or to the device for producing a high vacuum. Of course, if should be understood that additional stages could be added to the system without materially changing the inventive novel elements thereof, such as an intermediate vacuum processing stage. Further, the vacuum generating elements might operate in tandem, rather than sequentially, to provide the increasing levels of vacuum.

The containers preferably are designed for receiving casting ladles, and the containers for the casting ladles are preferably made with vacuum-tight covers which can be placed on them.

The plant of the present invention preferably includes containers having devices for the introduction of gases into the melt.

The plant of the present invention also preferably includes containers which are connected to a branch pipeline of a main pipeline connecting the high vacuum device, the containers having or blocking devices for controlling or stopping the free flow of gas in the pipeline and in addition a suction pipeline connected to one of the water ring pumps for producing the moderate vacuum having a valve or blocking device for controlling or stopping the free flow of gas connected between the branch pipeline of the high vacuum device between the container and the respective vacuum device blocking devices. Thus, the high vacuum and the moderate vacuum each may be selectively connected to a common manifold to the container by respective blocking devices.

The present invention also includes a method for the secondary metallurgical processing of steel melts under vacuum, in particular with the use of a plant as described herein, including the processing steps of refining the melt with the simultaneous addition of oxygen, boiling out of the melt following the addition of oxygen, addition of reducing agents with subsequent processing time for the degassing and desulfurizing of the melt, and correction of the analysis and alloying, at least one processing step being carried out with simultaneous introduction of a further gas, in particular an inert gas, into the melt and two containers each containing a melt being subjected simultaneously to the vacuum, one of the melt containers being treated under a moderate vacuum while the other melt, having previously been subjected to the moderate vacuum, being subjected in the same container to a high vacuum.

The moderate vacuum processing step of the present invention preferably is carried out in a range about 1 bar up to about 200 mbar and the high vacuum being carried out at a pressure level below the moderate vacuum, and most preferably below 1 mbar.

BRIEF DESCRIPTION OF THE DRAWING

The preferred embodiments are shown by way of example in the accompanying drawings with which.

DETAILED DESCRIPTION OF THE PREFERRED EMBODIMENTS

The present invention is further described with reference to FIGS. 6 and 7.

Figure 1:
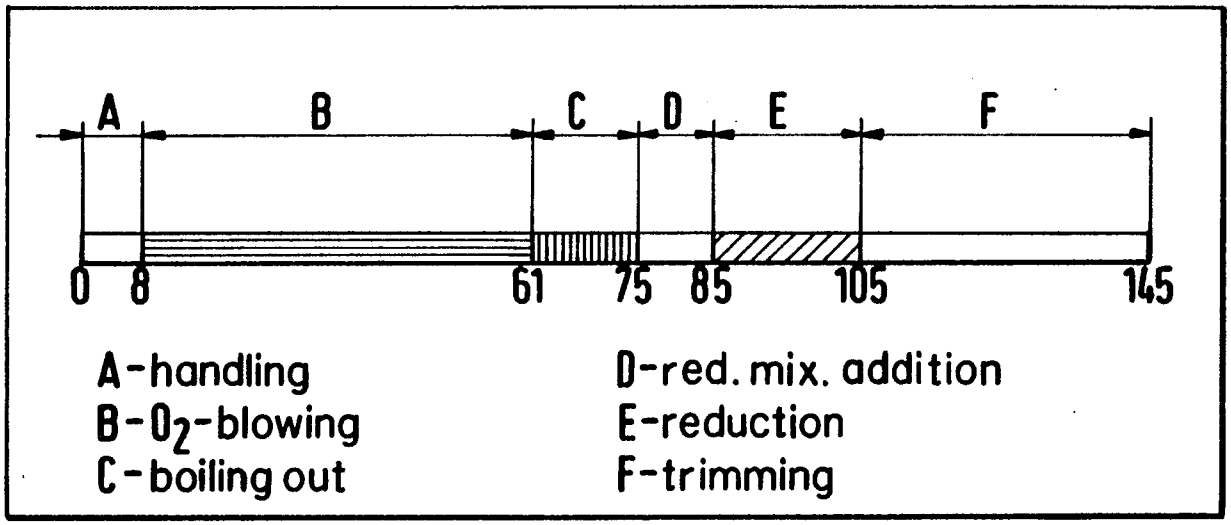
FIG. 1 shows a prior art sequence of the processing of VOD melts.
Figure 6:
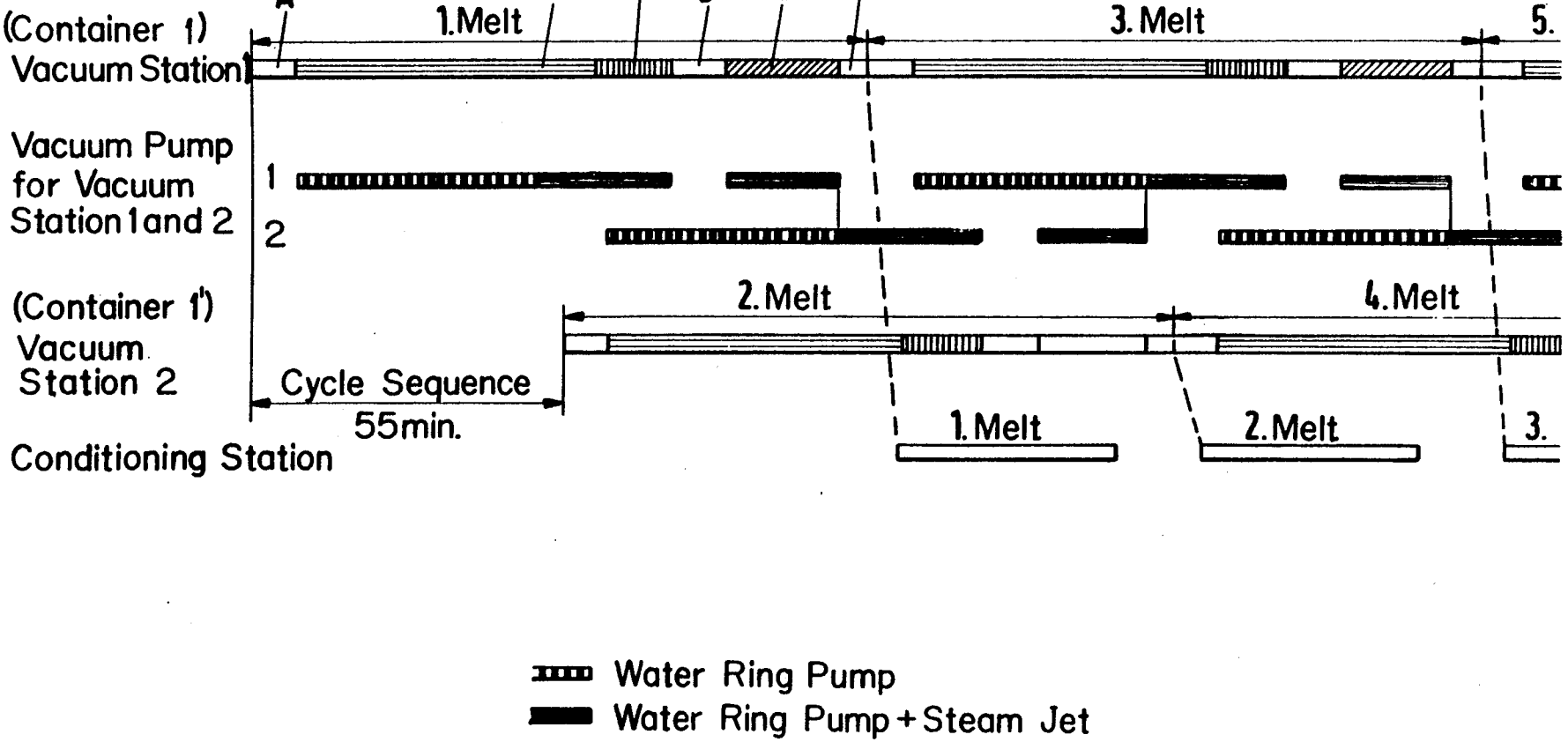
FIG. 6 shows a variant of the sequence of the present invention.

FIG. 6 shows a modification according to the present invention of the standard sequence generally according to FIG. 1. In the first line of the figure, there is initially indicated a VAK-station 1 (container 1), as in the usual treatment sequence of a melt in a VOD plant. The shown sequence differs from FIG. 1, by modification to shift the processing phase F into a conditioning stage.

Figure 7:
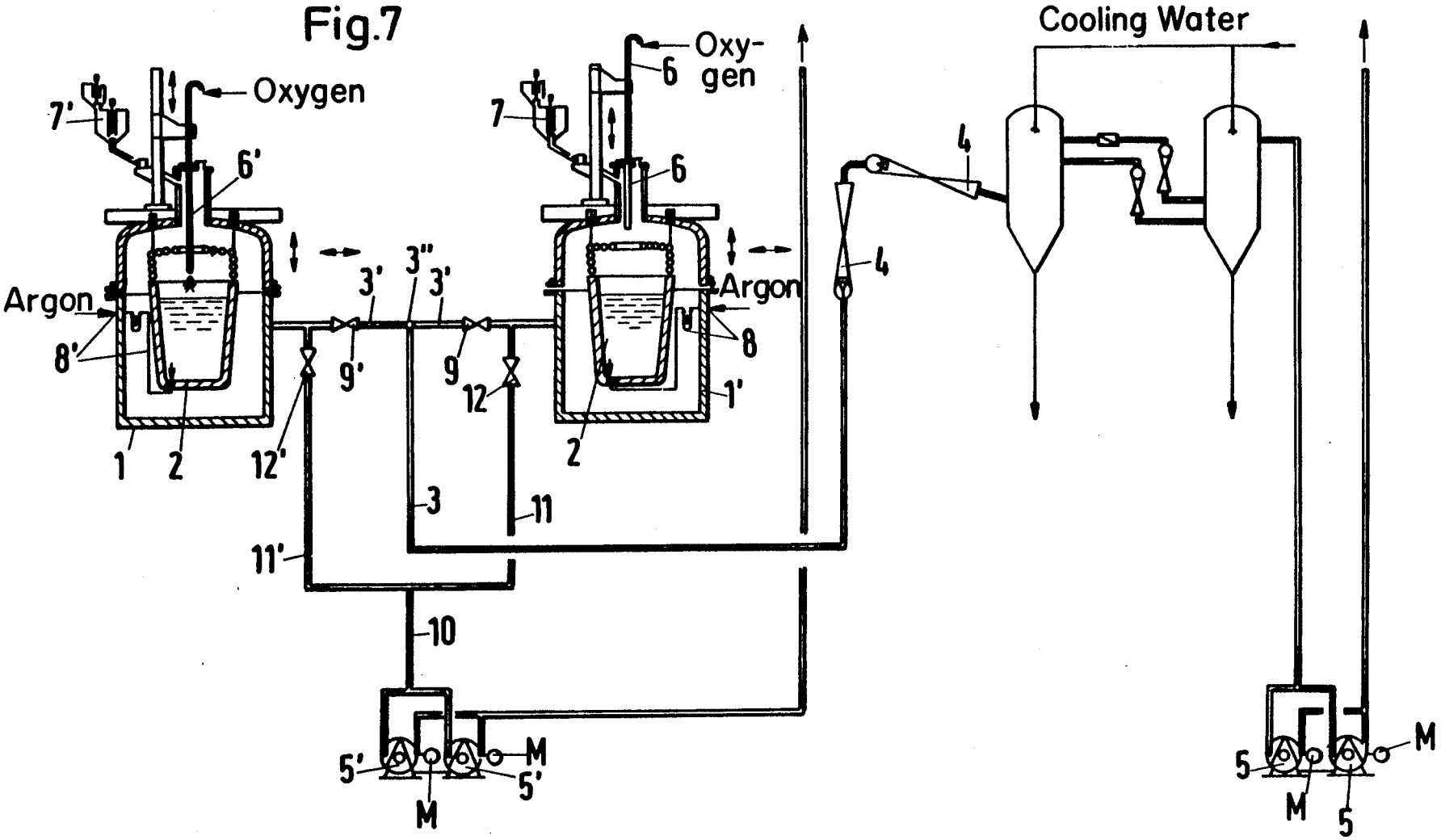
FIG. 7 shows diagrammatically the plant according to the present invention.

After completion of the preparatory work, indicated by the time period A, a moderate vacuum of, for example, about 180 mbar is produced in the container 1 of FIG. 7 via the suction line 10, 11' by turning on the water ring pumps 5' with the valve or blocking system 9, 9', 12 closed and with the valve or blocking system 12' opened. In the time period B, oxygen is blown onto the melt in the casting ladle through the oxygen feed device 6'. The oxygen feed can also take place through a deflagratable lance.

Toward the end of phase B, while the gas yield from the melt is decreasing, the blocking device 9' is opened and the blocking device 12' is simultaneously closed so that the container 1 is brought to a desired predetermined high vacuum level by the water ring pumps 5 and the steam jets 4. During this time period oxygen can continue to be blown. After the oxygen feed has ceased, the processing phase C, for boiling out, and phase E for reduction with the introduction of scavenging gases follow.

During this processing in the container 1, a further ladle 2 is placed in the vacuum station 2, shown as container 1'in FIG. 7, and a processing step is carried out similar to the process previously described with respect to the ladle 1. Thus, for the container 1', the blocking device 12 is opened so that a moderate vacuum is produced in the container 1' by means of the water ring pumps 5' via the pipelines 10, 11.

When the phase E processing is completed, after a specified or predetermined processing time for the first ladle in container 1, the preprocessing of the melt in container 1' is finished at the same time. Thus, there is a parallel processing of the containers through the plant, wherein the processing is divided into a number of stages, and the various stages have similar required processing times so that the containers each spend approximately the same time at each processing station. This allows for variations in the required processing between the melting apparatus and the casting apparatus. It also allows for about twice the amount of melt to be processed, with a substantially reduced high vacuum processing condition requirement.

In the case of the example selected, the first melt is now transferred to a conditioning station (not shown in FIG. 7) and the processing is completed. The container 1 is now available to receive a third casting ladle while the container 1' can be subjected to a high vacuum by corresponding actuation of the blocking devices. Thus, the containers are recycled through the process and each may by used is the various processing steps. Such an arrangement also allows a somewhat continuous processing of melt.

While in the present example water ring pumps are always used as devices for the producing of a moderate vacuum and a combination of water ring pumps and steam jets are used for the producing of a high vacuum, a steam jet arrangement of suitable design also can be used for the moderate vacuum.

Figure 5:
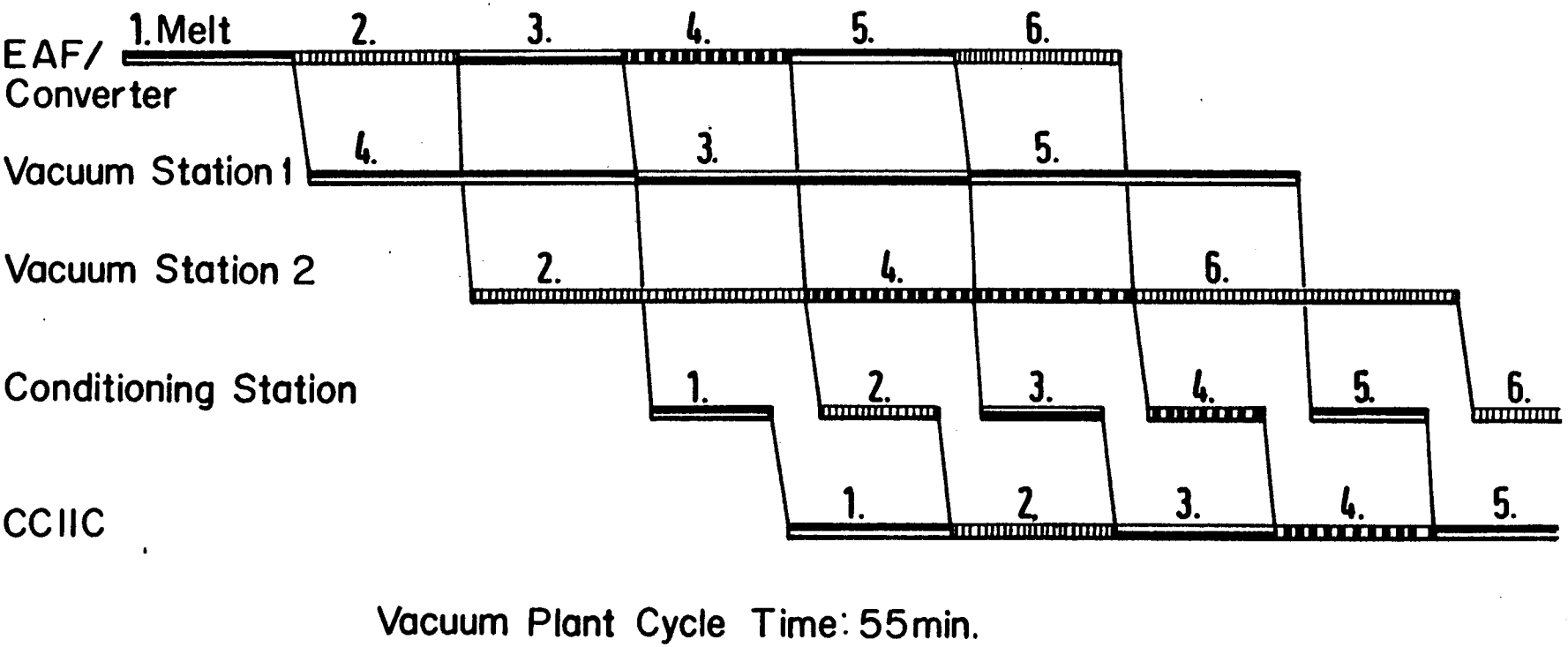
FIG. 5 shows a sequence according to the present invention.

In FIG. 5 there is shown a diagram of the time periods of the processing solution in accordance with the present invention with inclusion of an electric-arc furnace or converter and a continuous casting plant. The cycle time of the vacuum plant thus constructed amounts to about 55 min. The effects of the solution in accordance with the present invention and the respective impact on processing time, productivity and plant size can be noted from the following summary.

Results on modification of the solution of the invention according to FIG. 5 versus the Prior Art solutions.

Figure 2:
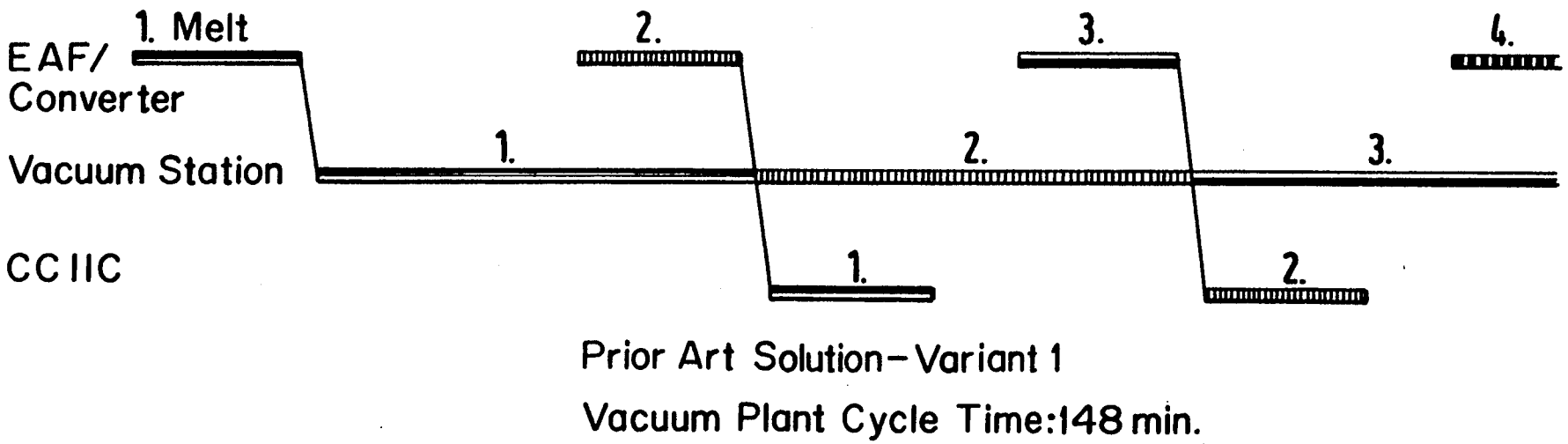
FIG. 2 shows a first variant sequence of the prior art solution.
Figure 3:
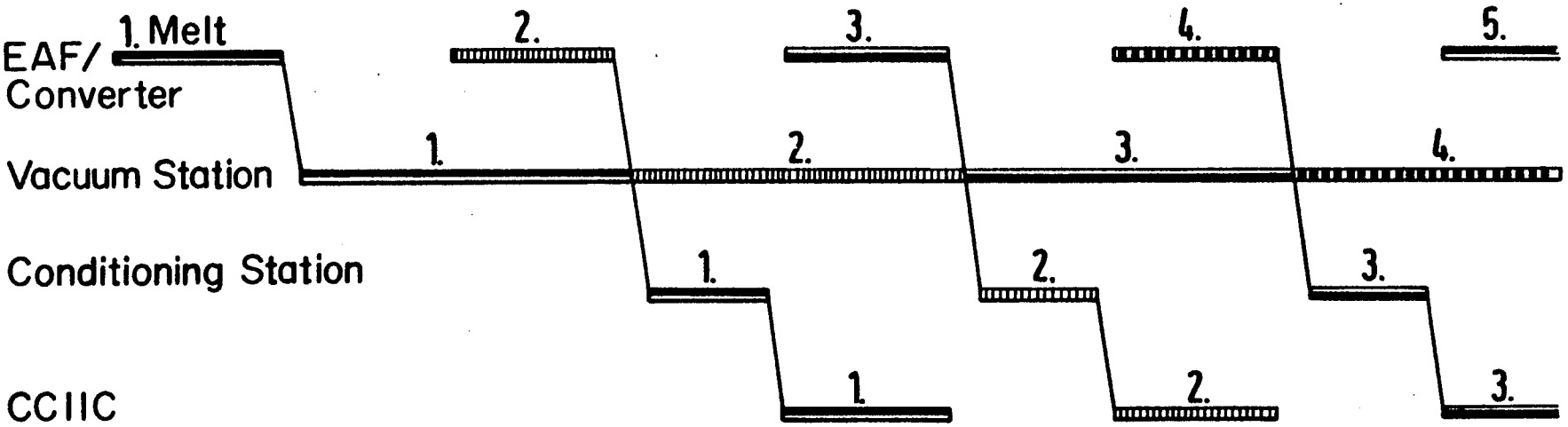
FIG. 3 shows a second variant sequence of the prior art solution.
Figure 4:
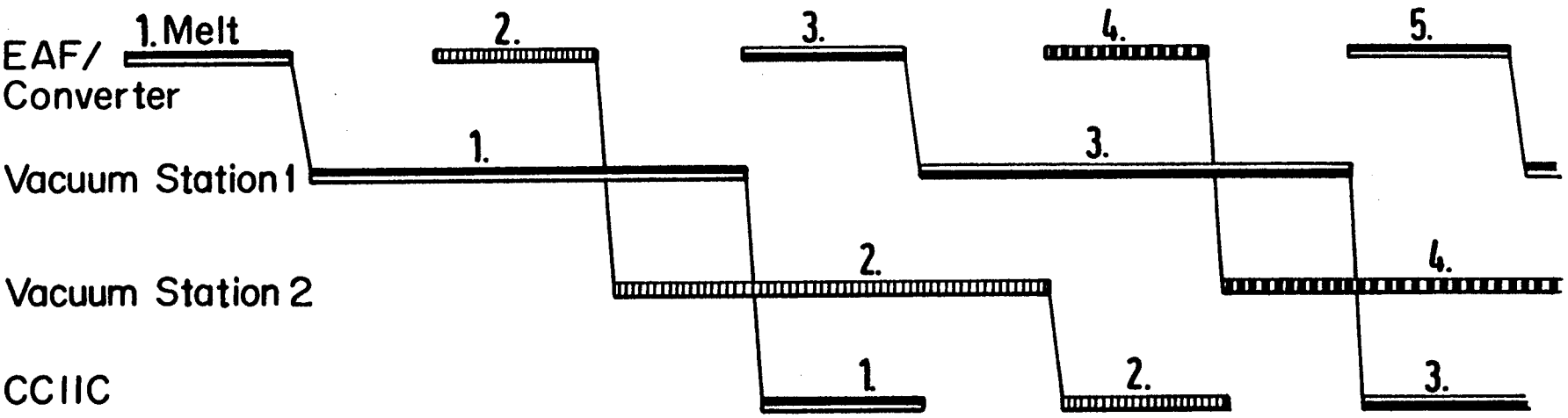
FIG. 4 shows a third variant sequence of the prior art solution.

| | FIG. 2 100% or t | FIG. 3 100% or t | FIG. 4 100% or t |
|---|---|---|---|
| Processing time | 37% | 50% | 54% |
| Productivity | 269%/t | 200%/t | 186%/t |
| Plant size | 37 t | 50 t | 54 t |

It should be noted that, assuming the same cycle time for the prior art solutions as well as the solution of the present invention, these effects occur also in the case of the preceding and subsequent melting and casting facilities. For example, with the solution in accordance with the present invention, assuming the same level of production, the plant size could be reduced from 100 to 54 t in comparison with the prior art embodiment shown in FIG. 4, including melting facility as well as vacuum and continuous casting plants.

The present invention claims priority from German Patent Application No. P. 41 14613.1, filed May 2, 1991, the entirety of which is expressly incorporated herein by reference.

It should be understood that the preferred embodiments and examples described are for illustrative purposes only and are not to be construed as limiting the scope of the present invention which is properly delineated only in the appended claims.

What is claimed is:

1. A plant for secondary metallurgical processing of molten steel, arranged within a production sequence having a melting apparatus and a continuous casting apparatus, the plant comprising:

a first evacuable container and a second evacuable container for molten steel, each having an oxygen feed device for supplying oxygen to the molten steel and an additive feed device for supplying an additive to the molten steel;

a first vacuum device for producing a first vacuum;

a second vacuum device for producing a second vacuum, said second vacuum being a lower pressure than said first vacuum;

a connection means for selectively connecting one of said first vacuum device and said second vacuum device to said first container of said second container.

2. The plant according to claim 1, wherein said first vacuum device comprises a water ring pump and said second vacuum device comprises a water ring pump and a steam jet.

3. The plant according to claim 1, wherein said first and said second containers are not simultaneously connected to said first and second vacuum devices.

4. The plant according claim 1, further comprising a casting ladle, wherein said casting ladle is of a size suitable for being placed in said first or said second container.

5. The plant according claim 2, further comprising a casting ladle, wherein said casting ladle is of a size suitable for being placed in said first or said second container.

6. The plant according claim 3, further comprising a casting ladle, wherein said casting ladle is of a size suitable for being placed in said first or said second container.

7. The plant according to claim 1, wherein said first and said second containers further comprise sealable vacuum-tight covers.

8. The plant according to claim 2, wherein said first and said second containers further comprise sealable vacuum-tight covers.

9. The plant according to claim 3, wherein said first and said second container further comprise sealable vacuum-tight covers.

10. The plant according to claim 1, further comprising a gas introduction device for introducing a gas into a melt in one of said containers.

11. The plant according to claim 2, further comprising a gas introduction device for introducing a gas into a melt in one of said containers.

12. The plant according to claim 3, further comprising a gas introduction device for introducing a gas into a melt in one of said containers.

13. The plant according to claim 1, further comprising a first vacuum line in communication with said first vacuum device and a second vacuum line in communication with said second vacuum device, said first vacuum line being connected through a first blocking device to said first container and through a second blocking device to said second container, and said second vacuum line being connected to said first container through a third blocking device to said first container and through a fourth blocking device to said second container.

14. The plant according to claim 2, further comprising a first vacuum line in communication with said first vacuum device and a second vacuum line in communication with said second vacuum device, said first vacuum line being connected through a first blocking device to said first container and through a second blocking device to said second container, and said second vacuum line being connected to said first container through a third blocking device to said first container and through a fourth blocking device to said second container. container and through a fourth blocking device to said second container.

15. The plant according to claim 3, further comprising a first vacuum line in communication with said first vacuum device and a second vacuum line in communication with said second vacuum device, said first vacuum line being connected through a first blocking device to said first container and through a second blocking device to said second container, and said second vacuum line being connected to said first container through a third blocking device to said first container and through a fourth blocking device to said second container.

16. A method for secondary metallurgical processing of first and second steel melts, comprising the steps of:

(a) refining each melt with simultaneous addition of oxygen;

(b) boiling out of each melt subsequent to the addition of oxygen;

(c) adding reducing agents to each melt after boiling out of the oxygen and allowing sufficient processing time for the degassing and desulfurizing of the melt;

(d) subjecting each melt to a first vacuum;

(e) subjecting the first melt, subsequent to said first vacuum to a second vacuum simultaneously with subjecting the second melt to said first vacuum, wherein said second vacuum is a substantially lower pressure than said first vacuum; and (e) correction of melt analysis and alloying, at least one of said steps being carried out with simultaneous introduction of an inert gas into the melt.

17. The method according to claim 16, wherein the first vacuum is in a range from about 1 bar to about 200 mbar.

18. The method according to claim 17, wherein said second vacuum is a pressure below about 1 mbar.

* * * * *